US009971294B2

(12) United States Patent
Shibata

(10) Patent No.: US 9,971,294 B2
(45) Date of Patent: May 15, 2018

(54) IMAGE FORMING APPARATUS AND CONVEYANCE CONTROL METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kyoichi Shibata, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 10 days.

(21) Appl. No.: 14/809,636

(22) Filed: Jul. 27, 2015

(65) Prior Publication Data

US 2017/0031293 A1 Feb. 2, 2017

(51) Int. Cl.

| | |
|---|---|
| ***G03G 15/23*** | (2006.01) |
| ***G03G 15/00*** | (2006.01) |
| ***B65H 1/00*** | (2006.01) |

(52) U.S. Cl.

CPC ..... *G03G 15/6529* (2013.01); *B65H 1/00* (2013.01); *G03G 15/234* (2013.01); *G03G 15/6508* (2013.01); *G03G 2215/00586* (2013.01)

(58) Field of Classification Search

CPC ..... G03G 15/6529; G03G 2215/00586; G03G 15/234

See application file for complete search history.

(56) References Cited

U.S. PATENT DOCUMENTS

| | | | | |
|---|---|---|---|---|
| 6,646,758 | B1 * | 11/2003 | Anderson | G06K 15/00 358/1.15 |
| 6,895,197 | B2 | 5/2005 | Shibata | |
| 2012/0026515 | A1 * | 2/2012 | Muramoto | G03G 15/36 358/1.2 |
| 2014/0078205 | A1 * | 3/2014 | Hayashi | B41J 11/003 347/16 |

FOREIGN PATENT DOCUMENTS

JP 2004322397 A * 11/2004

* cited by examiner

*Primary Examiner* — R. A. Smith
*Assistant Examiner* — John M Royston
(74) *Attorney, Agent, or Firm* — Amin, Turocy & Watson LLP

(57) ABSTRACT

In accordance with an embodiment, an image forming apparatus comprises a sheet feed section and a conveyance control section. The sheet feed section is provided with a plurality of cassettes in which sheets of a plurality of categories are stored for each category of the sheets, and feeds a sheet stored in the cassettes. The conveyance control section enables, in a case in which a sheet is fed from a cassette in which sheets to be printed after the printing surfaces thereof are aligned are stored among the cassettes, a reversal unit reversing the front side and the back side of the sheet at the time when the sheet is fed to convey and discharge the sheet regardless of a printing method designated by a user.

10 Claims, 6 Drawing Sheets

| CASSETTE | CATEGORY OF SHEET | SIMPLEX PRINTING | DUPLEX PRINTING | DUPLEX PRINTING (INCLUDING FRACTION PAGE) |
|---|---|---|---|---|
| FIRST CASSETTE | PLAIN | SIMPLEX CONVEYANCE | DUPLEX CONVEYANCE | SIMPLEX CONVEYANCE |
| SECOND CASSETTE | LETTERHEAD | DUPLEX CONVEYANCE | | |

IMAGE FORMING APPARATUS AND CONVEYANCE CONTROL METHOD

FIELD

Embodiments described herein relate generally to an image forming apparatus and a conveyance control method.

BACKGROUND

Generally, a paper printed by an image forming apparatus such as an MFP (Multi-functional Peripheral) is discharged in such a manner that the printing surface thereof faces down and then stacked in a tray.

In a case of duplex printing, the paper is printed in an order from the second page to the first page, and is discharged in such a manner that a printing surface of which the page number is smaller faces down. However, for example, in a case in which a duplex printing of a document of 3 pages is carried out, a simplex printing is carried out in the last fraction page. If a simplex conveyance and simplex printing is carried out in the fraction page, the printing page numbers respectively corresponding to the front side and the back side of the paper are changed when compared with a case in which a duplex conveyance and duplex printing is carried out in the fraction page.

Conventionally, in order to consistent with the printing surface of the paper of the fraction page in the duplex printing, a duplex conveyance and simplex printing method has been carried out.

However, in the method described above, the printing surfaces corresponding to the front side and the back side of the paper are changed in both a case in which a simplex printing is designated initially and a case in which a duplex printing is designated. Thus, a printing processing may be carried out sometimes while the printing surface isn't kept at the same.

DETAILED DESCRIPTION

In accordance with an embodiment, an image forming apparatus comprises a sheet feed section and a conveyance control section. The sheet feed section is provided with a plurality of cassettes in which sheets of a plurality of categories are stored for each category of the sheets, and feeds a sheet stored in the cassettes. The conveyance control section enables, in a case in which a sheet is fed from a cassette in which sheets to be printed after the printing surfaces thereof are aligned are stored among the cassettes, a reversal unit reversing the front side and the back side of the sheet at the time when the sheet is fed to convey and discharge the sheet regardless of a printing method designated by a user.

Hereinafter, an image forming apparatus and a method according to the embodiment are described with reference to the accompanying drawings.

Figure 1:
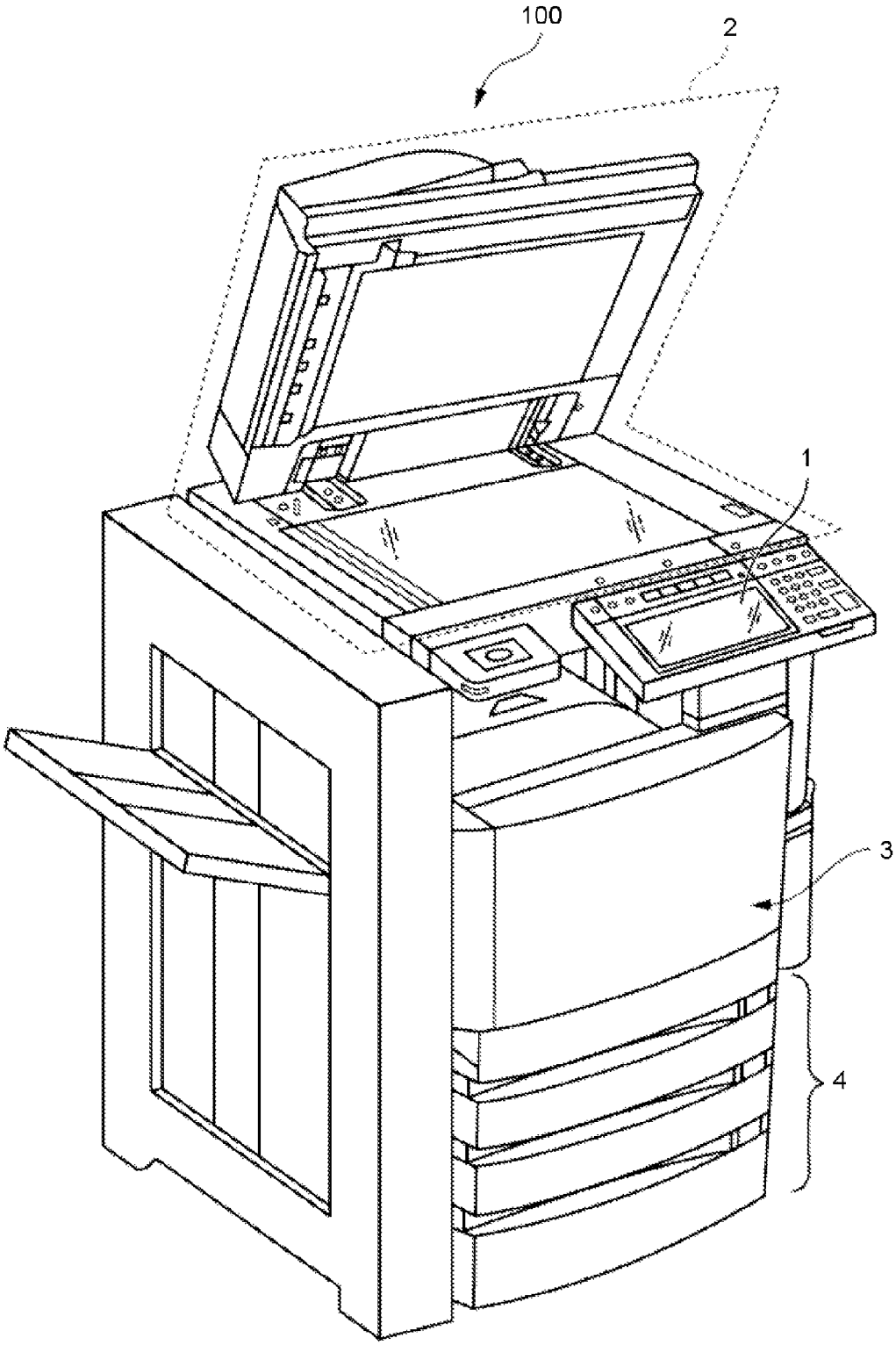
FIG. 1 is an external view illustrating an example of an image forming apparatus 100 according to a first embodiment.

FIG. 1 is an external view illustrating an example of an image forming apparatus 100 according to a first embodiment.

The image forming apparatus 100 reads a sheet to generate digital data (image file). For example, the image forming apparatus 100 is an MFP (Multi-functional Peripheral) that is capable of forming a toner image on the sheet. For example, the sheet is an image receiving medium on which an original, characters, an image and the like are recorded, and no limitation is given to the sheet as long as it can be read by the image forming apparatus 100.

In the example shown in FIG. 1, the image forming apparatus 100 comprises a display section 1, a scanner section 2, a print section 3 and a sheet feed section 4.

The display section 1 is an image display device such as a liquid display, an organic EL (Electro Luminescence), a display and the like. The display section 1 operates as an output interface to display characters and images. The display section 1 also operates as an input interface to receive an input of instructions from the user. For example, the display section 1 receives an instruction indicating whether to print the printing data with simplex printing or to print the printing data with duplex printing from the user. The instructions input to the display section 1 are to be input to the image forming apparatus 100.

The scanner section 2 is, for example, a color scanner comprising a CIS (Contact Image Sensor), a CCD (Charge Coupled Devices) and the like. The scanner section 2 reads a sheet using a sensor to generate digital data.

The print section 3 transfers an output image to the sheet based on the digital data generated by the scanner section 2 to print an image, characters and the like on the sheet. The output image is an output image (hereinafter referred to as a "toner image") that is visualized through a developing agent such as toner. The print section 3 applies heat and pressure to the sheet to which the toner image is transferred to fix the toner image on the sheet.

The sheet feed section 4 supplies a sheet for printing to the print section 3. The sheet feed section 4 is provided with a plurality of cassettes in which sheets of a plurality of categories are stored for each category of sheets. The sheet feed section 4 supplies the sheets stored in the designated cassette one by one to the print section 3 at timings when the toner image is formed in the print section 3.

Figure 2:
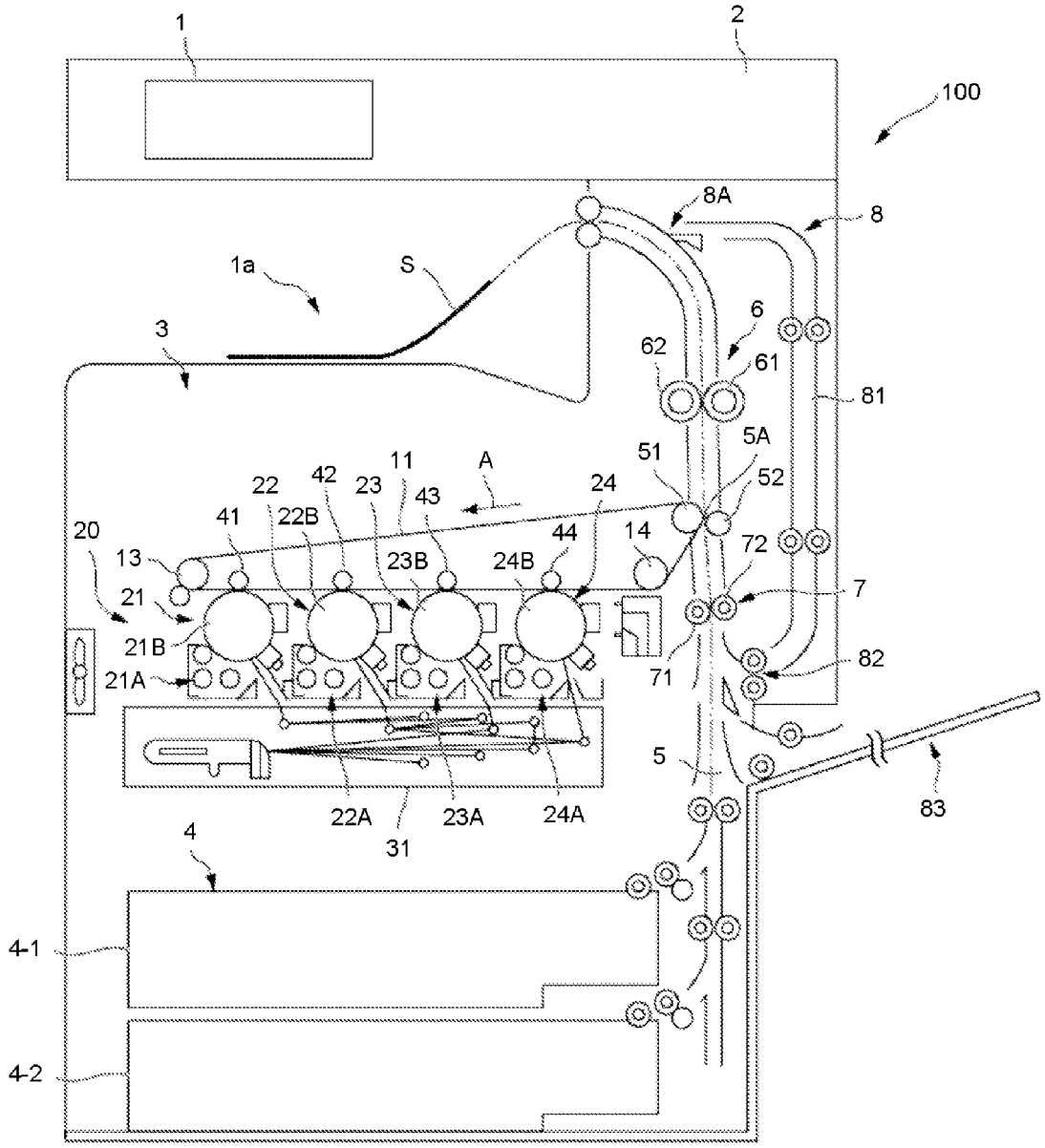
FIG. 2 is a schematic diagram illustrating an example of the whole constitution of the image forming apparatus 100 according to the embodiment.

FIG. 2 is a schematic diagram illustrating an example of the whole constitution of the image forming apparatus 100 according to the embodiment.

As shown in FIG. 2, the sheet feed section 4 includes two cassettes 4-1 and 4-2. The cassettes 4-1 and 4-2 respectively store sheets of different categories. For example, a plain plane sheet on the two surfaces is stored in the cassette 4-1. For example, a letterhead sheet is stored in the cassette 4-2. The letterhead sheet is a specific print paper in which a logo, a frame border and the like are printed in advance. In the present embodiment, the letterhead sheet is a sheet to be printed after the printing surfaces thereof are aligned. Further, in the following description, the cassette 4-1 is recorded as a first cassette, and the cassette 4-2 is recorded as a second cassette.

A conveyance path 5 conveying a sheet S from the sheet feed section 4 to the print section 3 is arranged between the sheet feed section 4 and the print section 3. A transfer position 5A is arranged on the route of the conveyance path 5. The transfer position 5A is a position where the toner image formed in the print section 3 is transferred to the sheet S. The sheet S is conveyed to a fixing device 6 passing through the transfer position 5A.

Further, in the following description, an upstream side in a flow of the sheet S conveyed on the conveyance path 5 is recorded as an upstream side of the conveyance path 5. Further, a downstream side in a flow of the sheet S conveyed on the conveyance path 5 is recorded as a downstream side of the conveyance path 5.

The print section 3 comprises the fixing device 6, a register roller pair 7, a reversal unit 8, an intermediate transfer belt 11 and an image forming section 20.

The intermediate transfer belt 11 is arranged at a given position inside the image forming apparatus 100. For example, the intermediate transfer belt 11 is arranged at the lower side in the vertical direction of the fixing device 6. For example, the intermediate transfer belt 11 is an insulative film having a given thickness, and is formed into a belt shape. The intermediate transfer belt 11 may also be a thin sheet-like metal of which the surface is protected by resin and the like.

The intermediate transfer belt 11 is applied with a given tension through a transfer driving roller 51, a first tension roller 13 and a second tension roller 14. Through the rotation of the transfer driving roller 51, any position on the intermediate transfer belt 11 that is parallel to the axis of the transfer driving roller 51 is moved in a direction indicated by an arrow A. In other words, the belt surface of the intermediate transfer belt 11 is circulated in one direction at a speed at which the outer peripheral surface of the transfer driving roller 51 is moved.

The image forming section 20 is arranged in a zone where the belt surface of the intermediate transfer belt is substantially moved like a plane in a state in which the given tension is applied.

The image forming section 20 comprises image forming units 21, 22, 23 and 24. The image forming units 21, 22, 23 and 24 are arranged at given intervals. For example, the image forming units 21, 22, 23 and 24 are arranged between the first tension roller 13 and the second tension roller 14.

The image forming units 21, 22, 23 and 24 include developing devices 21A, 22A, 23A and 24A and photoconductors 21B, 22B, 23B and 24B respectively. Each of the developing devices 21A, 22A, 23A and 24A houses toner of any one color. For example, C (cyan), M (magenta), Y (yellow) and BK (black) toner is respectively housed in the developing devices 21A, 22A, 23A and 24A different form each other.

An exposure device 31 is arranged at a position facing the photoconductors 21B, 22B, 23B and 24B. The exposure device 31 forms an electrostatic image corresponding to a color that is should be developed on the photoconductors 21B, 22B, 23B and 24B. Toner is supplied to the photoconductors 21B, 22B, 23B and 24B through the developing devices 21A, 22A, 23A and 24A in a selectable manner. In this way, the electrostatic images on the surface of the photoconductors 21B, 22B, 23B and 24B are developed with toner. As a result, a toner image is formed on the surface of each of the photoconductors 21B, 22B, 23B and 24B.

Facing rollers 41, 42, 43 and 44 are arranged at positions opposite to the photoconductors 21B, 22B, 23B and 24B across the intermediate transfer belt 11. Each of the facing rollers 41, 42, 43 and 44 presses the intermediate transfer belt 11 against the photoconductors 21B, 22B, 23B and 24B, respectively. In this way, the toner images formed on the photoconductors 21B, 22B, 23B and 24B are transferred to the intermediate transfer belt 11. The toner images on the surfaces of the photoconductors 21B, 22B, 233 and 24B are sequentially transferred to the intermediate transfer belt 11 at given timings. That the toner image is transferred to the intermediate transfer belt 11 is referred to as a primary transfer. Through the primary transfer, the toner image of each color is formed on the intermediate transfer belt 11. The toner image of each color is overlapped with each other at a given position on the surface of the intermediate transfer belt 11.

At the transfer position 5A is arranged on the route of the conveyance path 5, a transfer passive roller 52 is arranged to be contacted with the intermediate transfer belt 11 under a given pressure. The transfer passive roller 52 is pressed against the transfer driving roller 51 across the intermediate transfer belt 11.

A bias voltage is applied between the transfer driving roller 51 and the transfer passive roller 52. The charged toner moves from the intermediate transfer belt towards the transfer passive roller 52. Thus, the toner image of each color is overlapped with each other on the surface of the intermediate transfer belt 11. The toner image of each color is transferred to the sheet S from the intermediate transfer belt 11 at the transfer position 5A. That the toner image is transferred from the intermediate transfer belt 11 to the sheet S is referred to as a secondary transfer.

Further, in a case in which it is not required to transfer the toner image to the sheet S, the transfer passive roller 52 is arranged at a retracting position through a roller releasing mechanism (not shown). The retracting position is arranged at a position where the transfer passive roller 52 isn't contacted with the intermediate transfer belt 11.

A register roller pair 7 is arranged at a given position on the conveyance path 5 from the sheet feed section 4 to the transfer position 5A. The register roller pair 7 includes a register driving roller 71 and a register passive roller 72. The register driving roller rotates in a given direction. The register passive roller 72 is pressed against the register driving roller under a given pressure through a pressure contact mechanism (not shown). The sheet S conveyed from the sheet feed section 4 passes through the register roller pair 7 to enter the transfer position 5A. The register roller pair 7 adjusts a conveyance direction of the sheet S when entering the transfer position 5A.

The sheet S which is conveyed along the conveyance path 5 from the sheet feed section 4 towards the transfer position 5A is contacted with the register roller pair 7 and stopped temporarily. The sheet S is sometimes inclined during a period it is conveyed along the conveyance path 5 from the sheet feed section 4. Edges of the inclined sheet S are in a state in which the direction of the edges of the inclined sheet S are not consistent with a conveyance direction perpendicular to rotation axes of the register roller pair 7. In this case, a straight line at the front end of the sheet S is not parallel to the rotation axes of the register roller pair 7. By contacting the front end of the sheet S with the register roller pair 7, the straight line at the front end of the sheet S becomes parallel to the rotation axes of the register roller pair 7. In this state, the register roller pair 7 nips the sheet S, and in this way, the inclination of the sheet S to the conveyance direction is corrected.

The toner image is conveyed towards the transfer position 5A through the intermediate transfer belt 11. The register roller pair 7 is rotated again in response to a timing at which the toner image arrives at the transfer position 5A. The toner image is conveyed through the intermediate transfer belt 11 to approach the transfer position 5A. The sheet S reaches the transfer position 5A at a timing at which the toner image approaches the transfer position 5A. Then the sheet S passes through the transfer position 5A. In this way, the toner image is transferred to the sheet S.

The fixing device 6 applies heat and pressure to the toner image transferred to the sheet S. In this way, the toner image is fixed on the sheet S. The fixing device 6 includes a fixing driving roller 61 and a fixing passive roller 62. The fixing driving roller 61 rotates in a given direction. The fixing passive roller 62 is pressed against the fixing driving roller 61 under a given pressure through a pressure contact mechanism (not shown).

The sheet S on which the toner image is fixed through the fixing device 6 is guided to a sheet discharge section 1*a* along the conveyance path 5. The sheet discharge section 1*a* is a part of an exterior cover covering the print section 3. The sheet discharge section 1*a* is a space between the print section 3 and the scanner section 2.

A simplex printing is carried out on the sheet S through the processing described above.

Further, a branching point 8A is arranged to guide the sheet S to a direction different from that of the sheet discharge section 1*a* at the downstream side of the fixing device 6 on the conveyance path 5. In a case in which a duplex printing is carried out on the sheet S, the sheet S is temporarily discharged to the sheet discharge section 1*a*. Then, the sheet S is drawn to the print section 3 again. The sheet S is guided to the reversal unit 8 through the branching point 8A.

The reversal unit 8 conveys the sheet S along a conveyance path 81 inside the reversal unit 8.

In the present embodiment, an upstream side in a flow of the sheet S conveyed on the conveyance path 81 is recorded as an upstream side of the conveyance path 81. A downstream side in a flow of the sheet S conveyed on the conveyance path 81 is recorded as a downstream side of the conveyance path 81.

A reversal unit register roller pair 82 is arranged in the reversal unit 8.

Similar to the register roller pair 7, the reversal unit register roller pair 82 temporarily stops the sheet S that is conveyed on the conveyance path 81. In this way, the inclination of the sheet S is corrected. Further, the reversal unit register roller pair 82 restarts the conveyance of the sheet S at a timing at which the toner image enters the transfer position 5A. The sheet S conveyed from the reversal unit register roller pair 82 merges with the conveyance path 5.

There is a position where the sheet S discharged from the reversal unit register roller pair 82 merges with the conveyance path 5 on the conveyance path 5. The sheet S inserted from the manual feeding tray 83 is inserted from an upstream side of the position where the sheet S merges with the conveyance path 5 on the conveyance path 5.

A duplex printing is carried out on the sheet S through the processing described above. Further, in the following description, a control to enable the reversal unit 8 to convey the sheet S is recorded as a duplex conveyance, and a control to enable the reversal unit 8 not to convey the sheet S is recorded as a simplex conveyance.

Figure 3:
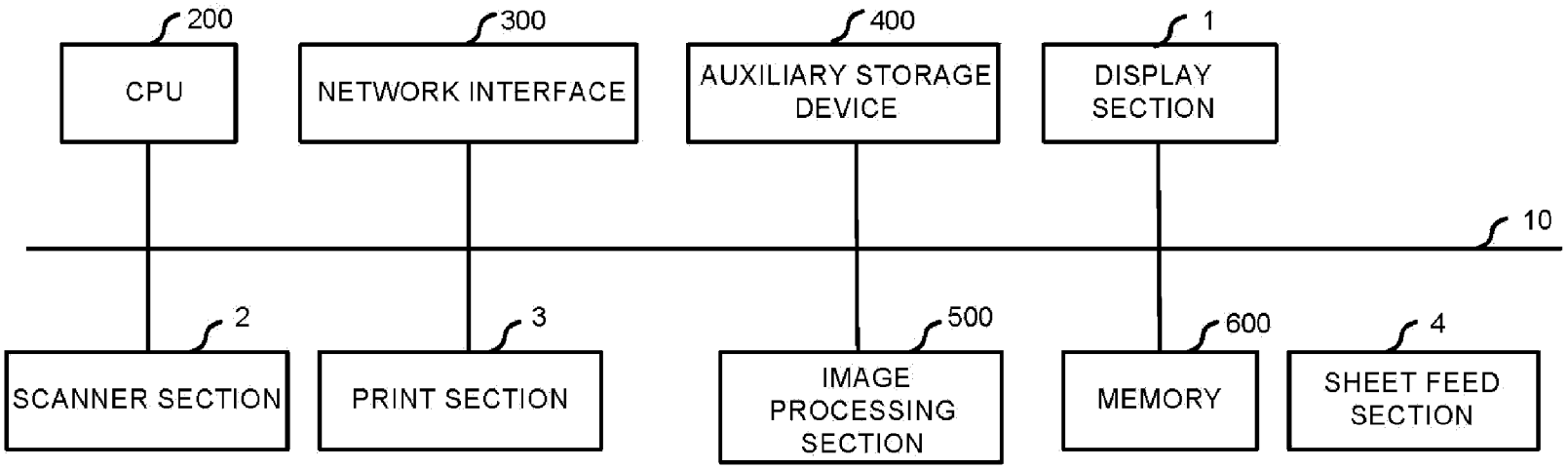
FIG. 3 is a functional block diagram illustrating functional components of the image forming apparatus 100.

FIG. 3 is a functional block diagram illustrating functional components of the image forming apparatus 100.

The image forming apparatus 100 comprises a CPU (Central Processing Unit) 200, a network interface 300, an auxiliary storage device 400, the display section 1, the scanner section 2, the print section 3, an image processing section 500, a memory 600 and the sheet feed section 4. The functional sections of the image forming apparatus 100 are connected with an internal bus 10 to be capable of carrying out data input/output with each other. Further, same reference numerals as shown in FIG. 1 are applied to the functional sections described in FIG. 1, and therefore the description thereof is not provided.

The CPU 200 controls the operations of each functional section of the image forming apparatus 100. The CPU 200 executes programs to execute various kinds of processing. The CPU 200 acquires an instruction input by the user from the display section 1. The CPU 200 controls a sheet conveyance method based on the acquired instruction.

The network interface 300 carries out a data transmission/reception with other device. The network interface 300 operates as an input interface to receive data sent from the other device. The network interface 300 further operates as an output interface to send data to the other device.

The auxiliary storage device 400, which is, for example, a hard disk or an SSD (solid state drive), stores various data. For example, the auxiliary storage device 400 stores digital data and a conveyance control database. The conveyance control database consists of records (hereinafter referred to as "conveyance control record") representing information relating to conveyance control corresponding to a printing method set for each cassette.

The image processing section 500 carries out an image processing on the digital data generated by the scanner section 2.

The memory 600 is, for example, an RAM (Random Access Memory). The memory 600 temporarily stores data used by the functional sections of the image forming apparatus 100. Further, the memory 600 may store the digital data generated by the scanner section 2.

Figures 4, 5:
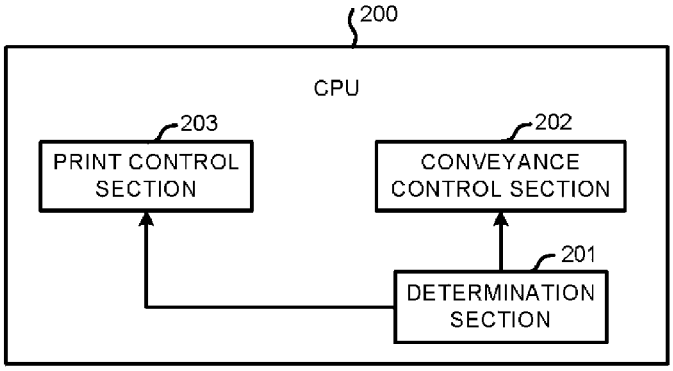
FIG. 4 is a diagram illustrating a concrete example of a conveyance control database.
FIG. 5 is a block diagram illustrating functional components of a CPU 200.

FIG. 4 is a diagram illustrating a concrete example of the conveyance control database.

The conveyance control database contains a plurality of conveyance control records. The conveyance control record consists of each value of a cassette, a category of sheet, a simplex printing, a duplex printing and a duplex printing (including fraction page). The value of cassette represents identification information for identifying the cassettes of the sheet feed section 4. The value of category of sheet represents a category of sheets stored in a cassette in a same conveyance control record. As a concrete example of category of sheet, a plain sheet and a letterhead sheet can be listed. The value of simplex printing represents a conveyance method in a case in which simplex printing is carried out on the sheets stored in the cassette in the same conveyance control record. The value of duplex printing represents a conveyance method in a case in which duplex printing is carried out on the sheets stored in the cassette in the same conveyance control record. The value of duplex printing (including fraction page) represents a conveyance method in a case in which duplex printing is carried out on the sheets stored in the cassette in the same conveyance control record and there is fraction page.

In the example as shown in FIG. 4, a plurality of cassettes is registered in the conveyance control database. These cassettes are the "first cassette" and the "second cassette". In FIG. 4, the value of cassette is the "first cassette", the value of category of sheet is "plain", the value of simplex printing is "simplex conveyance", the value of duplex printing is "duplex conveyance" and the value of duplex printing (including fraction page) is "simplex conveyance" in a conveyance control record registered at the top of the conveyance control database. That is, it is represented that the category of the sheet stored in the "first cassette" is the "plain sheet", the sheet is subjected to "simplex conveyance" in a case in which a simplex printing is carried out, the sheet is subjected to "duplex conveyance" in a case in which a duplex printing is carried out, and the sheet is subjected to "simplex conveyance" in a case in which a duplex printing is carried out and there is fraction page.

In FIG. 4, the value of cassette is the "second cassette", the value of category of sheet is the "letterhead", each of the values of simplex printing, duplex printing and duplex printing (including fraction page) is "duplex conveyance" in a conveyance control record registered at the second line of the conveyance control database. That is, it is represented that the category of the sheet stored in the "second cassette" is the "letterhead sheet", the sheet is subjected to "duplex conveyance" regardless of the simplex printing and the duplex printing.

Further, information of each cassette registered in the conveyance control database can be properly changed according to the operations of the user.

FIG. 5 is a block diagram illustrating functional components of the CPU 200.

As shown in FIG. 5, the CPU 200 comprises a determination section 201, a conveyance control section 202 and a print control section 203.

The determination section 201 determines a cassette (hereinafter referred to as a "sheet feed cassette") serving as a sheet feed target.

The conveyance control section 202 controls sheet conveyance based on the conveyance control database stored in the auxiliary storage device 400 and the instruction of a printing method from the user.

The print control section 203 controls the print section 3 to execute a printing processing on a sheet.

Figure 6A:
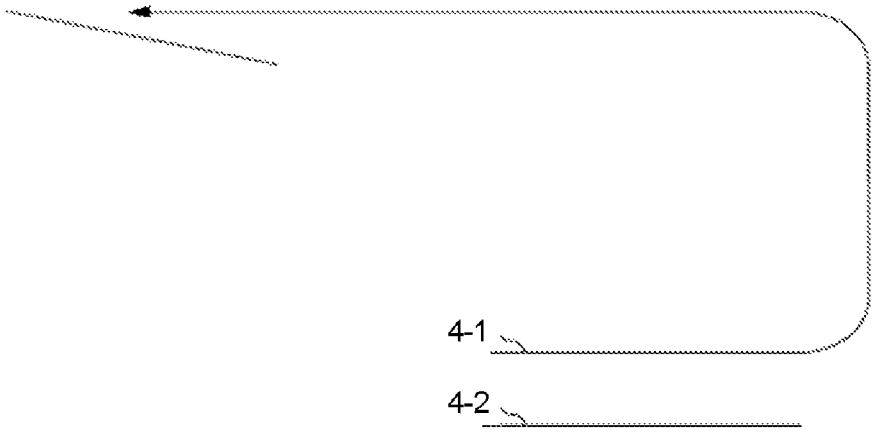
FIGS. 6A and 6B are diagrams illustrating a concrete example of conveyance control.
Figure 6B:
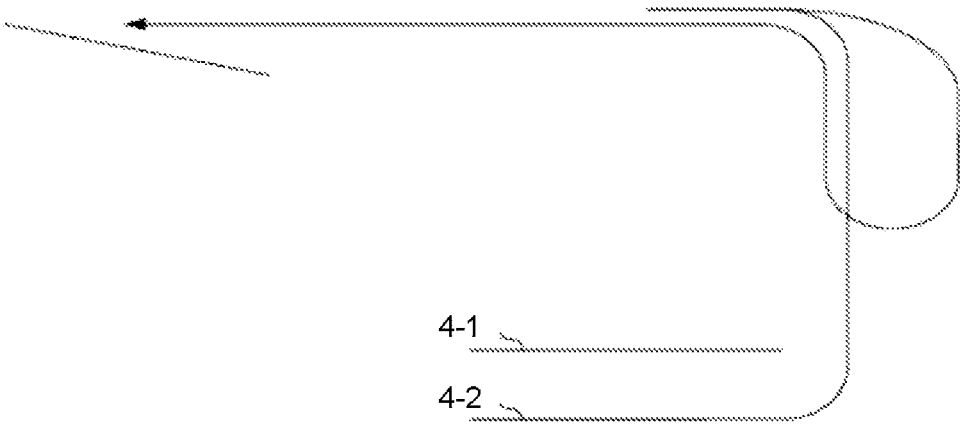

FIGS. 6A and 6B are diagrams illustrating a concrete example of conveyance control.

FIG. 6A is a diagram illustrating a concrete example of the simplex conveyance, and FIG. 6B is a diagram illustrating a concrete example of the duplex conveyance.

If an instruction of the simplex printing or the duplex printing (including fraction page) on a sheet stored in the cassette 4-1 is input, the sheet feed section 4 conveys the sheet as shown in FIG. 6A. At this time, the sheet is subjected to a simplex conveyance. Thus, the conveyance control section 202 controls each roller such that the sheet is subjected to the simplex conveyance, and the printed sheet is discharged facing down. In this way, if an instruction of the simplex printing or the duplex printing (including fraction page) on a sheet stored in the cassette 4-1 is input, the sheet is discharged without being conveyed by the reversal unit.

Further, if a printing instruction on a sheet stored in the cassette 4-2 is input, the sheet feed section 4 conveys the sheet as shown in FIG. 6B. At this time, whatever printing method is selected, the sheet is subjected to a duplex conveyance. Thus, the conveyance control section 202 controls each roller such that the sheet is subjected to the duplex conveyance, and discharges the printed sheet. In this way, if a printing instruction on a sheet stored in the cassette 4-2 is input, the sheet is conveyed by the reversal unit and then is discharged.

Figure 7:
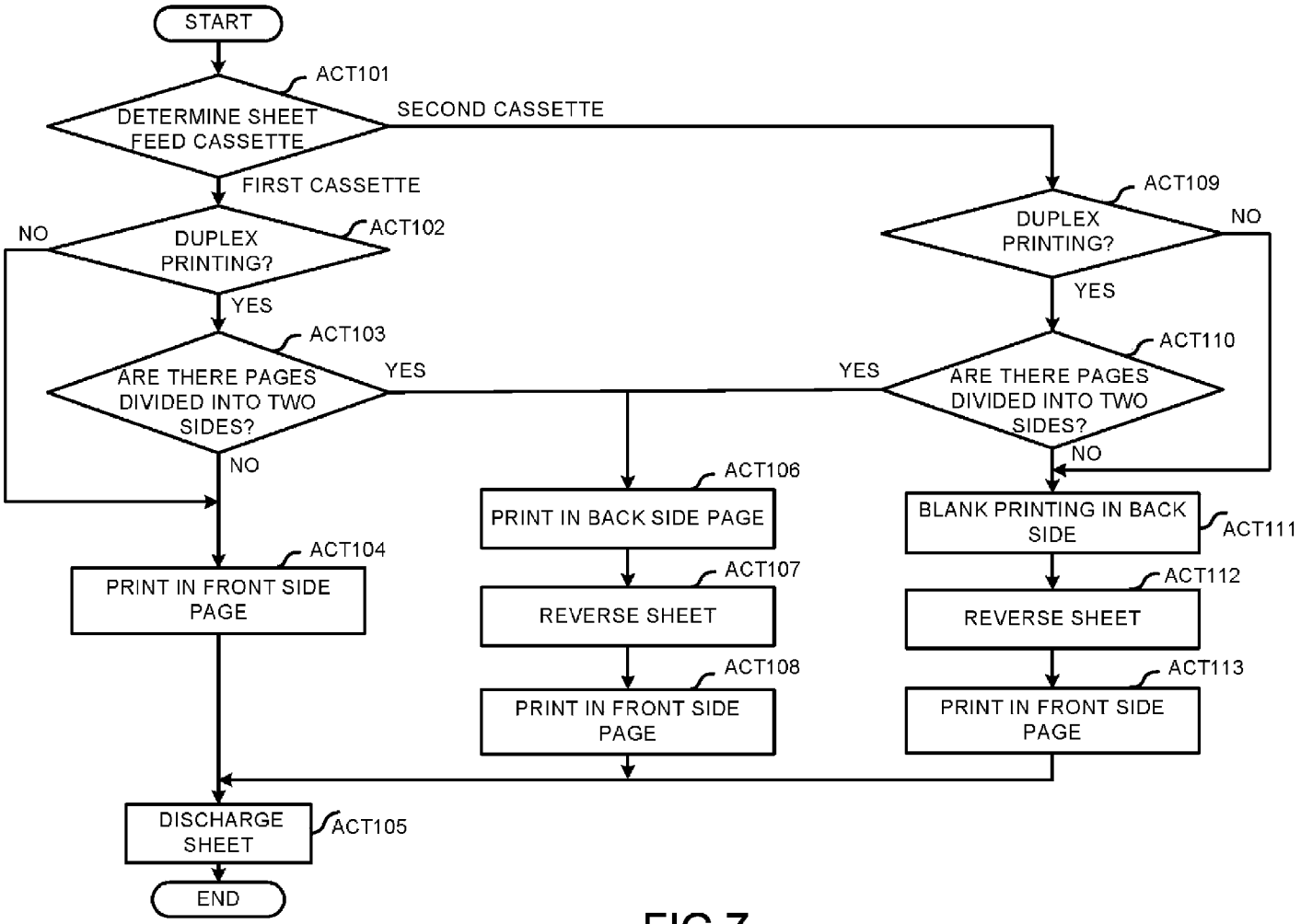
FIG. 7 is a flowchart illustrating a processing of the image forming apparatus 100.

FIG. 7 is a flowchart illustrating a processing of the image forming apparatus 100. The processing in FIG. 7 is executed if a printing execution instruction from the user is input.

The determination section 201 determines a sheet feed cassette (ACT 101). In a case in which the sheet feed cassette is the first cassette (first cassette in ACT 101), the conveyance control section 202 determines whether or not the printing method is a duplex printing (ACT 102). For example, the conveyance control section 202 determines whether or not it is a duplex printing based on a printing method that is set before a printing execution instruction from the user is input.

In a case in which the printing method is the duplex printing (YES in ACT 102), the conveyance control section 202 determines whether or not the digital data has pages divided into two sides (ACT 103). In a case in which there is no pages divided into two sides (NO in ACT 103), the conveyance control section 202 enables the sheet to be subjected to simplex conveyance based on the conveyance control database. The print control section 203 controls the print section 3 to print data of the digital data in the front side page. The print section 3 prints the data in the front side page on the conveyed sheet according to the control of the print control section 203 (ACT 104). Then, the conveyance control section 202 controls each roller to discharge the printed sheet (ACT 105).

In a case in which there are pages divided into two sides in the processing in ACT 103 (YES in ACT 103), the conveyance control section 202 enables the sheet to be subjected to duplex conveyance based on the conveyance control database. The print control section 203 controls the print section 3 to print data of the digital data in the back side page. The print section 3 prints the data in the back side page on the conveyed sheet according to the control of the print control section 203 (ACT 106). Then, the conveyance control section 202 enables the reversal unit 8 to convey the printed sheet to reverse the sheet (ACT 107). Next, the print control section 203 controls the print section 3 to print data of the digital data in the front side page. The print section 3 prints the data in the front side page on the conveyed sheet according to the control of the print control section 203 (ACT 108).

In a case in which the printing method is not the duplex printing in the processing in ACT 102 (NO in ACT 102), the image forming apparatus 100 executes processing from ACT 104.

In a case in which the sheet feed cassette is the second cassette in the processing in ACT 101 (second cassette in ACT 101), the following processing is carried out. For example, the conveyance control section 202 determines whether or not the printing method is a duplex printing (ACT 109). In a case in which the printing method is the duplex printing (YES in ACT 109), the conveyance control section 202 determines whether or not the digital data has pages divided into two sides (ACT 110). In a case in which there is no pages divided into two sides (NO in ACT 110), the conveyance control section 202 enables the sheet to be subjected to duplex conveyance based on the conveyance control database. The print control section 203 controls the print section 3 to print data of the digital data in the back side page. The print section 3 prints the data in the back side page on the conveyed sheet according to the control of the print control section 203. However, in this case, as there is no data of the digital data in the back side page, the print section 3 carries out a blank printing on the sheet (ACT 111). Then, the conveyance control section 202 enables the reversal unit 8 to convey the sheet subjected to the blank printing to reverse the sheet (ACT 112). Next, the print control section 203 controls the print section 3 to print data of the digital data in the front side page. The print section 3 prints the data in the front side page on the conveyed sheet according to the control of the print control section 203 (ACT 113).

In a case in which there are pages divided into two sides in the processing in ACT 110 (YES in ACT 110), the image forming apparatus 100 executes processing from ACT 106.

In a case in which the printing method is not the duplex printing in the processing in ACT 109 (NO in ACT 110), the image forming apparatus 100 executes processing from ACT 111.

In accordance with the image forming apparatus 100 with the constitutions described above, the deterioration in performance can be suppressed to the minimization, and a printing processing may be carried out while the printing surfaces with respect to the front side and the back side of the specific paper can be kept at the same. Hereinafter, the effect is described in detail.

It is assumed that a condition of desiring to aligning the printing surfaces with respect to the front side and the back side of the paper occurs in a case in which a printing processing is carried out on a specific paper. Therefore, the image forming apparatus 100 according to the embodiment carries out a duplex conveyance in all printing methods only in a case in which a specific paper like the letterhead sheet is fed. In addition, a conveyance control corresponding to the printing method is carried out in a case in which a paper commonly used like a plain sheet is fed. That is, a duplex printing is carried out on the paper commonly used like a plain sheet only if it is necessary. In this way, a processing the same as that performed on the specific paper is not carried out on the paper commonly used, and therefore it is possible to suppress the deterioration in performance to the minimization. Thus, the deterioration in performance can be suppressed to the minimization, and a printing processing may be carried out while the printing surfaces with respect to the front side and the back side of the specific paper can be kept at the same.

Hereinafter, a modification of the image forming apparatus 100 is described.

The processing procedures of the processing in ACT 106 and the processing in ACT 108 in FIG. 7 may be reversed. That is, the processing in ACT 106 may be executed after the processing in ACT 108 is executed first. Further, the processing procedures of the processing in ACT 111 and the processing in ACT 113 in FIG. 7 may be reversed. That is, the processing in ACT 111 may be executed after the processing in ACT 113 is executed first Further, it is exemplified in the present embodiment that the sheet feed section 4 includes two cassettes (the cassette 4-1 and the cassette 4-2). However, the present invention is not limited to this. For example, the sheet feed section 4 may include 3 or more than 3 cassettes. In this case, similar to the case in which two cassettes are arranged, the conveyance control section 202 controls sheet conveyance based on the conveyance control database.

In accordance with at least one embodiment described above, by comprising the sheet feed section 4 configured to be provided with a plurality of cassettes in which sheets of a plurality of categories are stored for each category of the sheets, and to feed a sheet stored in the cassettes; and the conveyance control section 202 configured to enable, in a case in which a sheet is fed from a cassette in which sheets to be printed after the printing surfaces thereof are aligned are stored among the cassettes, a reversal unit reversing the front side and the back side of the sheet at the time when the sheet is fed to convey and discharge the sheet regardless of the printing method designated by the user, it is possible to carry out a printing processing while the printing surface of the specific sheet can be always kept at the same.

The functions of the image forming apparatus 100 according to the embodiment described above may be realized by a computer. In this case, a program for realizing the functions is recorded in a computer-readable recording medium, and the program recorded in the recording medium is read by a computer system to be executed. Further, it is assumed that the "computer system" includes hardware such as an OS, a peripheral machine and the like. Further, the "computer-readable recording medium" refers to a storage device such as a removable medium including flexible disk, magnetic optical disk, ROM, CD-ROM and the like, a hard disk arranged inside the computer system, and the like. Further, the "computer-readable recording medium" may dynamically keep a program for a short time like a communication line in a case of sending a program via a network such as the Internet or via a communication line such as a telephone line, and may also keep a program for a constant time like a server or a volatile memory inside the computer system serving as a client in that case. Further, the program may be used to realize parts of the functions described above, and furthermore the aforementioned functions may also be realized through a combination of the program described above with a program that has already been recorded in the computer system.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a sheet feed section configured to feed sheets from first and second cassettes configured to store the sheets;

a first conveyance path extending from the first and second cassettes to a sheet discharge section;

a reversal unit configured to turn over the sheets;

a second conveyance path conveying the sheets from the sheet discharge section to the reversal unit, then merging to the first conveyance path the sheets from the reversal unit;

a conveyance control section configured to determine whether to convey the sheets of the first cassette to the first conveyance path or to both of the first conveyance path and the second conveyance path based on a printing method designated by a user, the conveyance control section configured to convey the sheets of the second cassette to both of the first conveyance path and the second conveyance path, independently of the printing method designated by a user;

a print section located on the first conveyance path; and a print control section configured to control the print section to print page data to a front side page on the sheets, to print a blank data to a back side page on the sheets, when the printing method designated by a user is simplex printing.

2. The image forming apparatus according to claim 1, wherein the conveyance control section enables the reversal unit to convey the sheet in a case in which the sheet is fed from a cassette where it is stored even in a case in which printing data to be printed on the sheet is to be printed in a fraction page.

3. The image forming apparatus according to claim 1, wherein as to a sheet fed from a cassette other than the cassette in which sheets to be printed after the printing surfaces thereof are aligned are stored, the conveyance control section doesn't enable the reversal unit to convey the sheet in a case in which a printing method designated by the user is simplex printing, enables the reversal unit to convey the sheet in a case of duplex printing, and doesn't enable the reversal unit to convey the sheet in a case in which there is a fraction page even in a duplex printing.

4. The image forming apparatus according to claim 1, further comprising:

a storage section configured to store first information including first and second records representing second and third information relating to conveyance control corresponding to a printing method set for each of the first and second cassettes; and an input section configured to designate whether the printing method for the first cassette and the second cassette is simplex printing or duplex printing, wherein:

the second information indicating simplex conveyance and duplex conveyance is registered in the first record corresponding to the first cassette, the simplex conveyance in which the sheets are conveyed to first conveyance path;

the third information indicating the duplex conveyance is registered in the second record corresponding to the second cassette;

the duplex conveyance is to convey the sheets from the first conveyance path to the second conveyance path and to convey the sheets from the second conveyance path to the first conveyance path;

when the instruction to designate the first cassette and the instruction to designate the simplex printing are input from the input section, the conveyance control section refers to the first record and performs the simplex conveyance;

when the instruction to designate the first cassette and the instruction to designate the duplex printing are input from the input section, the conveyance control section refers to the first record and performs the duplex conveyance; and when the instruction to designate the second cassette and the instruction to designate the simplex printing or the duplex printing are input from the input section, the conveyance control section refers to the second record and performs the duplex conveyance.

5. The image forming apparatus according to claim 1, wherein:

the print control section controls the print section so as to print the page data on one side of the sheet, when executing simplex conveyance by simplex printing;

the print control section controls the print section so as to print the page data on both sides of the sheet, when executing duplex conveyance by duplex printing; and the print control section controls the print section so as to print the page data to the front side page on the sheets, to print the blank data to the back side page on the sheets, when executing duplex conveyance by simplex printing.

6. A conveyance control method, comprising:

feeding sheets from first and second cassettes configured to store the sheets;

turning over the sheets;

determining whether to convey the sheets of the first cassette to a first conveyance path or to both of the first conveyance path and a second conveyance path based on a printing method designated by a user;

conveying the sheets of the second cassette to both of the first conveyance path and the second conveyance path, independently of the printing method designated by the user, the first conveyance path is to extend from the first and second cassettes to a sheet discharge section, the second conveyance path is to convey the sheets from the sheets discharge section to the reversal unit, then merging to the first conveyance path the sheets from a reversal unit;

controlling a print section located on the first conveyance path to print page data to a front side page on the sheets, to print a blank data to a back side page on the sheets, when the printing method designated by the user is simplex printing.

7. The conveyance control method according to claim 6, wherein the sheet is conveyed by the reversal unit in a case in which the sheet is fed from a cassette where it is stored even in a case in which printing data to be printed on the sheet is to be printed in a fraction page.

8. The conveyance control method according to claim 6, wherein as to a sheet fed from a cassette other than the cassette in which sheets to be printed after the printing surfaces thereof are aligned are stored, the sheet isn't conveyed by the reversal unit in a case in which a printing method designated by the user is simplex printing, the sheet is conveyed by the reversal unit in a case of duplex printing, and the sheet isn't conveyed by the reversal unit in a case in which there is a fraction page even in a duplex printing.

9. The conveyance control method according to claim 6, wherein storing first information including first and second records representing second and third information relating to conveyance control corresponding to a printing method set for each of the first and second cassettes; and designating whether the printing method for the first cassette and the second cassette is simplex printing or duplex printing, wherein:

the second information indicating simplex conveyance and duplex conveyance is registered in the first record corresponding to the first cassette, the simplex conveyance in which the sheets are conveyed to first conveyance path;

the third information indicating the duplex conveyance is registered in the second record corresponding to the second cassette;

the duplex conveyance is to convey the sheets from the first conveyance path to the second conveyance path and to convey the sheets from the second conveyance path to the first conveyance path;

referring to the first record and performing the simplex conveyance when the instruction to designate the first cassette and the instruction to designate the simplex printing are input from the input section;

referring to the first record and performing the duplex conveyance when the instruction to designate the first cassette and the instruction to designate the duplex printing are input from the input section; and referring to the second record and performing the duplex conveyance when the instruction to designate the second cassette and the instruction to designate the simplex printing or the duplex printing are input from the input section.

10. The conveyance control method according to claim 6, wherein controlling the print section so as to print the page data on one side of the sheet, when executing simplex conveyance by simplex printing;

controlling the print section so as to print the page data on both sides of the sheet, when executing duplex conveyance by duplex printing; and controlling the print section so as to print the page data to the front side page on the sheets, to print the blank data to the back side page on the sheets, when executing duplex conveyance by simplex printing.

* * * * *